US012735857B2

(12) United States Patent
Schuell et al.

(10) Patent No.: US 12,735,857 B2
(45) Date of Patent: Sep. 15, 2026

(54) GRAB DEVICE AND METHOD FOR OPERATING A GRAB DEVICE

(71) Applicant: BAUER Maschinen GmbH, Schrobenhausen (DE)

(72) Inventors: Andreas Schuell, Gerolsbach (DE); David Pfeiffer, Schrobenhausen (DE); Andreas Hugl, Burgheim (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 318 days.

(21) Appl. No.: 18/682,958

(22) PCT Filed: Aug. 3, 2022

(86) PCT No.: PCT/EP2022/071804
§ 371 (c)(1),
(2) Date: Feb. 12, 2024

(87) PCT Pub. No.: WO2023/016883
PCT Pub. Date: Feb. 16, 2023

(65) Prior Publication Data

US 2025/0137225 A1 May 1, 2025

(30) Foreign Application Priority Data

Aug. 12, 2021 (EP) ..... 21191054

(51) Int. Cl.
*E02F 3/43* (2006.01)
*E02F 3/47* (2006.01)
*E02F 3/60* (2006.01)

(52) U.S. Cl.
CPC ..... *E02F 3/47* (2013.01); *E02F 3/43* (2013.01); *E02F 3/60* (2013.01)

(58) Field of Classification Search
CPC ..... E02F 3/43; E02F 3/47; E02F 3/60
See application file for complete search history.

(56) References Cited

U.S. PATENT DOCUMENTS

2012/0263566 A1 10/2012 Taylor et al.

FOREIGN PATENT DOCUMENTS

DE 3615068 C1 * 10/1987 ..... E02F 3/413
EP 0533558 A1 3/1993

(Continued)

OTHER PUBLICATIONS

International Preliminary Report on Patentability and Written Opinion issued in PCT/EP2022/071804; issued Feb. 13, 2024.

(Continued)

*Primary Examiner* — Matthew R Buck
(74) *Attorney, Agent, or Firm* — Studebaker Brackett PLLC

(57) ABSTRACT

The invention relates to a method for operating a grab system, comprising a carrier device and a cable grab arranged thereon, which cable grab comprises a grab frame, which is held by a retaining cable on the carrier device, at least two grab buckets, which are mounted on a lower end of the grab frame, so as to be able to swivel between a closed position and an open position, and an actuating device with an actuating cable for swivelling the grab buckets, wherein an actuating cable is guided from the carrier device to the actuating device, and the carrier device has a driven first cable winch for the retaining cable and a driven second cable winch for the actuating cable, wherein the carrier device has an undercarriage and an upper carriage, which is mounted thereon for rotation about a vertical axis and has a cantilever arm on which the cable grab is vertically adjustably mounted, wherein in a removal step, in order to form a trench in the ground, the cable grab is lowered into the ground by the retaining cable with the grab buckets open, the grab buckets are closed to remove and collect soil material, the cable grab is pulled out of the ground by the retaining cable and swiveled to an emptying position, in which the (Continued)

Figure 1:
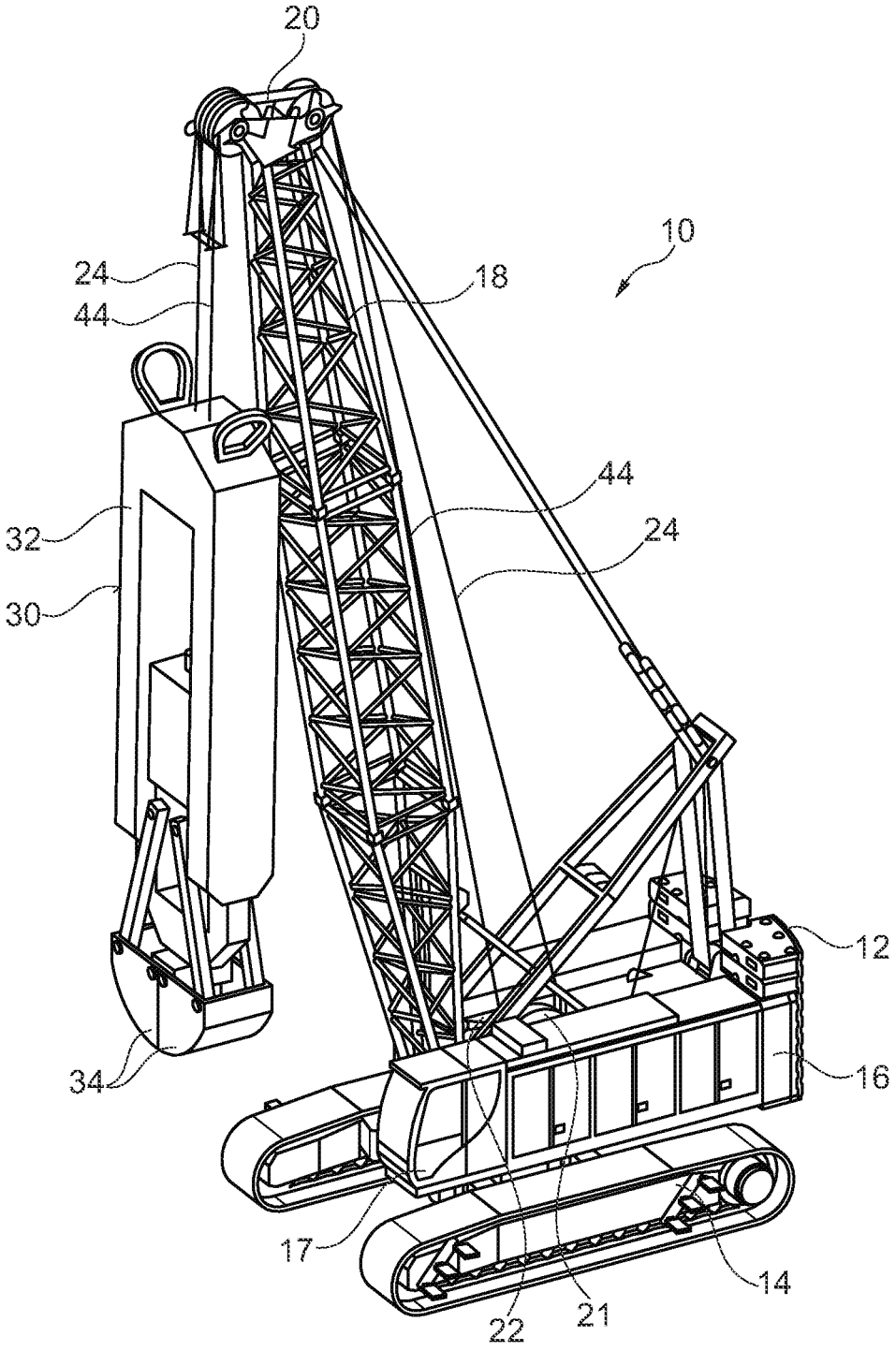

grab buckets are opened to discharge the collected soil material, by rotating the upper carriage, and then the cable grab is moved back into the ground trench to repeat the removal step. In accordance with the invention, a control device is provided with which a rotation of the upper carriage to the emptying position and an opening and closing of the grab buckets to discharge the soil material or a rotation of the upper carriage from the emptying position back to the ground trench are controlled automatically.

20 Claims, 3 Drawing Sheets

(56) References Cited

FOREIGN PATENT DOCUMENTS

| | | | | | |
|---|---|---|---|---|---|
| EP | 3798367 | A1 | | 3/2021 | |
| GB | 1271248 | A | | 4/1972 | |
| GB | 2126981 | A | | 4/1984 | |
| JP | H03-241118 | A | | 10/1991 | |
| JP | H08-143272 | A | | 6/1996 | |
| JP | 2001-064993 | A | | 3/2001 | |
| JP | 2003-041613 | A | | 2/2003 | |
| JP | 2003-147800 | A | | 5/2003 | |
| KR | 20130100421 | A | * | 9/2013 | ..... B66C 3/02 |
| WO | 2019/163875 | A1 | | 8/2019 | |

OTHER PUBLICATIONS

An Office Action; mailed by the Japanese Patent Office on Apr. 8, 2025, which corresponds to Japanese Patent Application No. 2024-508712 and is related to U.S. Appl. No. 18/682,958; with English language translation.

International Search Report issued in PCT/EP2022/071804; mailed Nov. 17, 2022.

* cited by examiner

GRAB DEVICE AND METHOD FOR OPERATING A GRAB DEVICE

The invention relates to a method for operating a grab device, comprising a carrier device and a cable grab arranged thereon, the cable grab comprising a grab frame, which is held by a retaining cable on the carrier device, at least two grab buckets, which are mounted on a lower end of the grab frame so as to swivel between a closed position and an open position, and an actuating device with an actuating cable for swivelling the grab buckets, wherein an actuating cable is guided from the carrier device to the actuating device, and the carrier device has a driven first cable winch for the retaining cable and a driven second cable winch for the actuating cable, wherein the carrier device has an undercarriage and an upper carriage, which is mounted on the undercarriage for rotation about a vertical axis and has a cantilever arm on which the cable grab is vertically adjustably mounted, wherein in a removal step, in order to form a trench in the ground, the cable grab is lowered into the ground by the retaining cable with the grab buckets open, the grab buckets are closed to remove and collect soil material, the cable grab is pulled out of the ground by the retaining cable and/or the actuating cable and swiveled into an emptying position, in which the grab buckets are opened to discharge the collected soil material, by rotating the upper carriage, and then the cable grab is moved back into the ground trench to repeat the removal step, according to the preamble of claim 1.

The invention further relates to a grab device, comprising a carrier device and a cable grab arranged thereon, the cable grab comprising a grab frame, which is held by a retaining cable on the carrier device, at least two grab buckets, which are mounted on a lower end of the grab frame so as to swivel between a closed position and an open position, and an actuating device with an actuating cable for swivelling the grab buckets, wherein an actuating cable is guided from the carrier device to the actuating device, and the carrier device has a driven first cable winch for the retaining cable and a driven second cable winch for the actuating cable, wherein the carrier device has an undercarriage and an upper carriage, which is mounted on the undercarriage for rotation about a vertical axis and has a cantilever arm from which the cable grab is vertically adjustably suspended, according to the preamble of claim 8.

Grab systems are used in specialist civil engineering to produce trenches in the ground. Trench walls for supporting and/or sealing excavation pits can be produced in the trenches.

Grab systems mostly comprise a grab having grab buckets, wherein the grab is suspended by a retaining cable from a carrier device, typically a jib crane. A grab can be lowered into the ground by the retaining cable. By closing the grab buckets, soil material can be removed and collected in the grab. The grab is then pulled out of the ground again by the retaining cable and/or actuating cable and swiveled by the carrier device into an emptying position in which the grab buckets are opened to discharge the soil material. The grab is then swiveled back into the working position and introduced into the trench in the ground for another grab operation.

Two different types of grabs exist which are used in such grab systems, namely hydraulic grabs and cable grabs. A so-called hydraulic grab is known from EP 3 798 367 A1, for example. In a hydraulic grab, the movement to open and close the grab buckets is generated by a hydraulic cylinder which is arranged on the grab frame.

Such hydraulic grabs are relatively easy to operate and control using the hydraulic system. However, suitable hydraulic lines for supplying and discharging hydraulic fluid are required, which run parallel to the retaining cable. Corresponding cable drums for the hydraulic lines, with corresponding winch drives and a correspondingly designed hydraulic system, are to be provided on the carrier device. This increases the size of the grab device accordingly and also makes it more expensive. The hydraulic system also requires additional maintenance effort.

By contrast, so-called cable grabs have a much simpler design. Such a cable grab is known from GB 2 126 981 A, for example. In a cable grab, the opening and closing movement of the grab buckets is brought about by an actuating cable. The actuating cable runs essentially parallel to the retaining cable, from the actuating device of the grab buckets to the carrier device. Using a separate winch for the actuating cable, the grab buckets can be opened or closed by unwinding or winding the actuating cable from or onto the winches.

In the case of a cable grab, there is no need for the elaborate feeding systems of hydraulic lines to the grab. Only an additional actuating cable with a corresponding winch is required. An actuating cable of this type also requires much less maintenance than hydraulic lines with a corresponding hydraulic system.

However, a cable grab is not as simple to operate as a hydraulic grab and requires an experienced machine operator. One reason for this lies mostly in the fact that, owing to the twofold arrangement of a non rotation-free cable, namely the retaining cable and the actuating cable, torques are generated in various operating states which torques cause a certain rotation of the cable grab around its longitudinal axis. However, an exact rotational position of the cable grab is essential, in order to be able to move the cable grab safely between the emptying position and a working position in which the cable grab is introduced into the ground to produce a trench.

A rotational position of the cable grab around its longitudinal axis can be achieved by a machine operator by applying certain tensile forces to the retaining cable and the actuating cable. A relatively precise operation of the corresponding cable winches is needful for this. This requires a certain degree of experience on the part of the machine operator along with a high level of concentration when carrying out the process. In addition, cable winches are frequently operated by means of foot pedals, so that operating the cable winches with such precision for several hours is also very strenuous for a machine operator.

The object of the invention is to specify a method for operating the grab device and a grab device for which, furthermore, a simple grab device design is provided and at the same time a simple operation is rendered possible.

This object is achieved on the one hand by a method having the features of claim 1 and on the other by a grab device having the features of claim 8. Preferred embodiments of the invention are indicated in the respectively dependent claims.

The method according to the invention is characterized in that a control device is provided with which a rotation of the upper carriage into the emptying position and an opening of the grab buckets to discharge the soil material and/or a rotation of the upper carriage from the emptying position back to the ground trench are controlled automatically. In doing so, a rotation of the grab device can take place around its vertical axis.

A basic idea of the invention is to provide a control device with which, firstly, a rotary drive for the upper carriage and, secondly, at least one cable winch for the actuating cable can be controlled in a coordinated manner. A rapid and efficient movement of the cable grab and an emptying at the emptying position can be achieved in this way. A complicated manual control by a machine operator and the coordination of the control of the rotation of the upper carriage and/or the grab device with the actuation of the cable winch for the actuating cable and the cable winch for the retaining cable using the conventionally available foot pedals can be avoided. This considerably reduces the burden on a machine operator, both in physical terms and in terms of coordination, especially since a simply constructed cable grab has a tendency to oscillate, i.e. to swing and/or rotate. The invention allows for a safe and efficient operation of a cable grab, even by a less experienced machine operator.

Alternatively or in addition, according to the invention the upper carriage can be rotated from the emptying position back to the ground trench. In this way, the repetitive movement of the cable grab from the working position at the ground trench to the emptying position and back can be carried out entirely automatically, almost entirely automatically or at least partly automatically by the control device. In this process, a first operation can initially be carried out manually by a machine operator, while a corresponding automatic program is generated by the control device in a teach-in procedure. Once the automatic program has been stored, it can be carried out repeatedly automatically, thereby resulting considerably reducing of the burden on the machine operator.

According to a variant of the invention, a particularly efficient emptying is achieved in that the control device opens the grab buckets while the cable grab is still oscillating, as a consequence of the rotation of the upper carriage. A dynamic emptying process can be achieved in this way, with no need for the cable grab to come to rest after oscillation above the emptying position. This means to speed up the work process considerably. The oscillating movement of the cable grab can be caused not only by the rotation of the upper carriage but also by the actuation of the cable winches. This oscillating movement can encompass not only an oscillation in an approximately horizontal direction but also a rotation or rotational oscillation in an approximately vertical direction. Both the cable winch for the actuating cable and the cable winch for the retaining cable can be controlled by the control device in such a way as to counteract an oscillating movement of the cable-suspended cable grab. This promotes workplace safety.

According to a further development of the invention, it is advantageous for a traversing movement of the cable grab into the ground trench and/or a retraction of the cable grab out of the ground trench to be controlled automatically by the control device. In principle, the introduction and withdrawal of the trench wall grab can also be performed automatically. The increasing depth of the trench can also be taken into consideration here. By preference, it is possible for the machine operator to carry out these or other process steps by himself at any times by engaging directly with the control device. In particular, the introduction of the trench wall grab into a trench in the ground can be controlled directly by the machine operator. As a precursor, the control device can execute a program step which leads to a slowdown of the movement of the cable grab both around a vertical axis (rotation) and transversely to the vertical axis (oscillation) immediately before it is introduced into the prepared trench.

It is further preferable for the control device to be connected to and to control the first cable winch and the second cable winch. In this way, a coordinated actuation of the retaining cable and actuating cable can take place, in order to limit undesired rotating and oscillating movements of the cable grab or to avoid them altogether.

According to a further development of the invention, a particularly expedient operation of the grab device is achieved through the provision of a sensor device with which an oscillating movement of the cable grab during rotation of the upper carriage is detected. The sensor device can be camera-based or can have other sensors, with or without contacts, with which an oscillating movement transversely to the vertical and/or a rotary oscillating movement around a vertical axis can be detected. The movement data thus obtained can be used by the control device, in particular to control one or both cable winches in order to counteract the undesired or excessive oscillating movement.

According to a further design variant of the invention, it is advantageous for an efficient grab operation for the grab buckets to be opened by the control device at the emptying position at a time when the oscillating cable grab is still in a deflected position relative to the vertical position. All in all, this speeds up the overall procedure. In addition, the deliberate emptying of the cable grab in a deflected position can counteract the oscillating movement since the resulting reduction in the oscillating mass damps the oscillating movement.

Moreover, a further efficient process flow can be achieved by introducing the oscillating cable grab into the ground trench by way of the control device, wherein the oscillating movement is damped by contact with the ground. Once a certain reduction in the oscillating movement has been achieved, a complete damping of the oscillating movement can be obtained by a targeted introduction of the cable grab into the ground trench.

With regard to the grab device according to the invention, the invention is characterized in that a control device is provided which is designed to automatically control a rotation of the upper carriage to an emptying position and an opening of the grab buckets to discharge soil material and/or a rotation of the upper carriage from the emptying position back to the ground trench. The previously described advantages can be achieved in this way.

Particularly preferably is that the grab device according to the invention is designed to carry out the method according to the invention as described above.

Moreover, in an embodiment of the grab device according to the invention, it is preferable that a first detection device for detecting a first cable force on the retaining cable and a second detection device for detecting a second cable force on the actuating cable are provided, and that the control device is connected to the first detection device, the second detection device, the first cable winch and the second cable winch and is designed to control the first cable winch and/or the second cable winch in accordance with a control program specification, depending on the detected first cable force on the retaining cable and the detected second cable force on the actuating cable.

One aspect of the invention is based on the knowledge that a torque on a cable grab around its longitudinal axis is dependent on the cable forces in the retaining cable and the actuating cable. Detection devices are provided with which a cable force on the retaining cable and a cable force on the actuating cable are detected. The respectively detected force values can be supplied to a control device which controls a first cable winch for the retaining cable and a second cable winch for the actuating cable, according to inputs and specifications by the machine operator. Thus, by means of an appropriate control of the corresponding cable winch (winding/unwinding), the forces in the retaining cable and in the actuating cable can be adjusted to one another by the control device such that in particular, in a given or desired rotational position of the cable grab, no torque around the longitudinal axis is generated on the cable grab by the retaining cable and actuating cable. In principle, the control device can also be used to generate a defined variable torque for a desired rotation by influencing the respective cable forces in an appropriate manner. An oscillating movement can be counteracted in this way.

A preferred embodiment of the invention resides in that a defined ratio between the first cable force in the retaining cable and the second cable force in the actuating cable is specified and can be set by the control program specification of the control device. Respectively identical or different designs of retaining cable and actuating cable can be taken into consideration accordingly in the control program specification. In the case of a retaining cable and actuating cable of preferably identical design, but with opposing cable lay directions, torque compensation can be achieved by setting broadly similar tensile forces in the cables. If the cables have differing designs, in terms of differing cable construction, this can be taken into consideration and preset accordingly in the control program specification. Additional geometric conditions in the cable grab, in terms of different attachment points of the cables on the grab frame for example, can also be preset and taken into consideration in the control program specification.

A further preferred embodiment of the invention resides in that the control device is designed with a compensation mode in which the cable winches are controlled in such a way that the first cable force on the retaining cable and the second cable force on the actuating cable are adjusted to each another. In particular, the cable winches can be controlled in such a way that the torques in the actuating cable and the retaining cable compensate for or weaken against each another. The rotational position of the cable grab around its longitudinal axis can be stabilized in this way. An undesired rotation of the cable grab around its longitudinal axis during operation can thus be largely avoided.

In particular, according to a further development of the invention, it is advantageous for the control device to be designed with a rotation mode in which the cable winches are controlled in such a way that a deliberate rotation of the cable grab around a vertical longitudinal axis can be generated. Starting from a stable rotational position, a desired change in the rotational position can be brought about by a machine operator. The control device can also be designed in such a way that a value or dimension for a desired rotation can be specified by the machine operator via an input device, wherein the winches are actuated by the control device according to the program logic, so as to bring about the desired modified rotational position.

A further preferred embodiment of the invention resides in that the control device is designed with a mode for opening and/or closing the grab buckets at a predefined height. This means that, during opening and/or closing, the two cable winches can be adjusted to each other in such a way that preferably the height of the lowest point of the grab buckets remains unchanged or a defined change in height is achieved. Thus, during closing for example, it is possible to control whether the teeth or tooth tips of the grab buckets move in a circular path or along a straight path or a defined path curve in between. This can be set, in particular according to the type of ground.

The grab can preferably be held freely suspended from the actuating cable and retaining cable, with closed grab buckets, wherein the cable force in the actuating cable and retaining cable is approximately the same, for example appropriately approximately +/−1 t. Initiated by a control command from the equipment operator, the winch on which the actuating cable is wound is automatically actuated in the unwinding direction, which can take place either in freefall or with friction locking. At the same time, the winch on which the retaining cable is wound is automatically actuated in the winding direction. This causes a slide in the grab body to move upwards and open the grab buckets via the push rods. By controlling the ratio of actuating cable unwinding to retaining cable winding, it can be achieved that a vertical movement of the grab body relative to the subgrade or ground during opening is prevented or minimized. Without this control, the grab body would otherwise move noticeably downwards when the grab buckets open.

Correspondingly, the control device can be designed with a mode for closing the grab buckets. This means that, during opening and/or closing, the two cable winches can be adjusted to each other in such a way that preferably the height of the lowest point of the grab buckets remains unchanged. Accordingly, during closing, it is possible to control in such a way, whether the teeth or tooth tips of the grab buckets move in a circular path or along a straight path or a path curve in between, which, in particular can be set according to the type of ground.

The grab can preferably be held freely suspended from the actuating cable and retaining cable, with open grab buckets, wherein the cable force in the retaining cable corresponds to almost the entire grab weight and the cable force in the actuating cable is in the range appropriately from approximately 1 t to 2 t. Initiated by a control command from the equipment operator, the winch on which the actuating cable is wound is automatically actuated in the winding direction and, at the same time, the winch on which the retaining cable is wound is automatically actuated in the unwinding direction, either in freefall or with friction locking. This causes the slide in the grab body to move downwards and close the grab buckets via the push rods.

By controlling the ratio of closing cable winding to retaining cable unwinding, it is possible to achieve that the vertical movement of the grab body relative to the subgrade or ground during closing is prevented or minimized. Without this control, the grab body would otherwise move noticeably upwards when the grab buckets close.

A further preferred embodiment of the invention resides further in that the control device is designed with a mode for automatically opening the grab buckets and closing them immediately afterwards.

The grab can preferably be held freely suspended from the actuating cable and retaining cable, with closed, filled grab buckets, wherein the cable force in the actuating cable and retaining cable is approximately the same, in particular appropriately approximately +/−1 t.

When the equipment operator actuates a control element, the processes of opening and closing again the grab buckets are carried out automatically in one operation. The aim here is for this operation to execute it as quickly as possible, since in the "grab buckets open" state the cable force in the retaining cable is much higher than in the actuating cable. This can cause the grab to rotate around the longitudinal axis. To counteract this rotation, before executing the automatic open/close operation, a rotary pulse can be generated in the opposite direction, in particular by deliberately and temporarily increasing the cable force in the actuating cable in an automated manner.

A further preferred embodiment of the invention resides in that the control device can detect the degree of opening of the grab buckets and display this to the operator.

By detecting the ratio of the depth or unwinding length of the retaining cable and actuating cable, it is possible for the device controller to determine the degree of opening of the grab buckets and, in particular to display it to an operator on a screen. This can be done by displaying a numerical value, such as degree of opening 50%, and/or by means of a graphical representation, such as a display of the grab buckets with an opening angle, or as a bar graph. Without this display, the degree of opening of the buckets and hence the state of the grab in the trench is not visible to the operator.

According to a further development of the invention, it is preferable for at least one third detection device for detecting a rotational position of the cable grab and/or a change in the rotational position to be provided. This can be achieved with an optical detection device, a rotary encoder, a gyroscope on the cable grab or by other suitable means. This enables to carry out feedback about the rotational position or rotation of the grab when it is controlled by the control device, so that regulation of the rotational position or rotation can take place. This allows the rotational position of the cable grab to be set with a high degree of accuracy.

According to a further embodiment of the invention results a further improvement in operability by providing at least one further detection device, in particular for detecting a vertical position of the cable grab, a distance and/or an angular position of the cable grab relative to the carrier device. The additional parameters detected in this way can be displayed directly to a machine operator and/or processed by the control device to control the grab.

A further advantageous embodiment of the invention resides in that a control panel is provided for a manual control to actuate the cable grab and/or the cable winches.

The control panel as an input device is designed, in particular in such a way that a desired rotation or movement of the cable grab can be entered by a machine operator, as a numerical value or angular dimension for example, preferably using appropriate operating elements, such as a cursor, a rotary knob, switches or buttons, in particular in combination with a display. Thus, the machine operator no longer has to enter the winches and a rotation of the winches directly. Instead, based on the operator input regarding the position of the grab, via the control device uses the program logic the machine with the individual motors and control elements is controlled so as to adjust the desired position largely without undesired rotations.

According to a design variant of the invention, it is particularly preferable for the control device to be designed with an automatic program with which the cable grab can be moved automatically to an emptying position and/or to a removal position. In this case, an automatic program can be permanently stored or, in the case of repetitive operations, can be individually defined and saved by a machine operator. Relatively long movement sequences of the grab, in particular a movement to the emptying position and/or back to a removal position, can thus be performed automatically. Such cable grab traversing paths occur, in particular when producing deep trenches in the ground with a high repetition frequency.

In principle, the individual cables can be of identical or different design. According to an embodiment of the invention, it is particularly advantageous that the retaining cable on the first cable winch is wounded in a first direction which is opposite to a second winding direction of the actuating cable on the second cable winch. In particular, the retaining cable and the actuating cable have a mutually opposite lay direction or a so-called cable lay. Thus, when a tensile force is applied, mutually opposite torques are generated in the cables. This facilitates compensating of the torques to stabilize the position of the cable grab during operation.

According to a further embodiment of the invention, it is particularly advantageous that a display screen is provided for the control device for operation. In this case, the display screen can, in particular be designed as a touchscreen on which at least some of the operating elements are implemented for a machine operator.

Furthermore, a position of the cable grab can be displayed on the display screen in various representations, to further simplify actuation for a machine operator.

The grab device can be used, in particular for various tasks. In a preferred method variant, soil is removed and, in particular a trench is prepared in the ground using the cable grab. The cable grab can, in particular be designed as a so-called trench wall grab, with which a trench can be prepared for a sealing wall and/or supporting wall in the ground, for enclosing an excavation pit for example.

Figure 2:
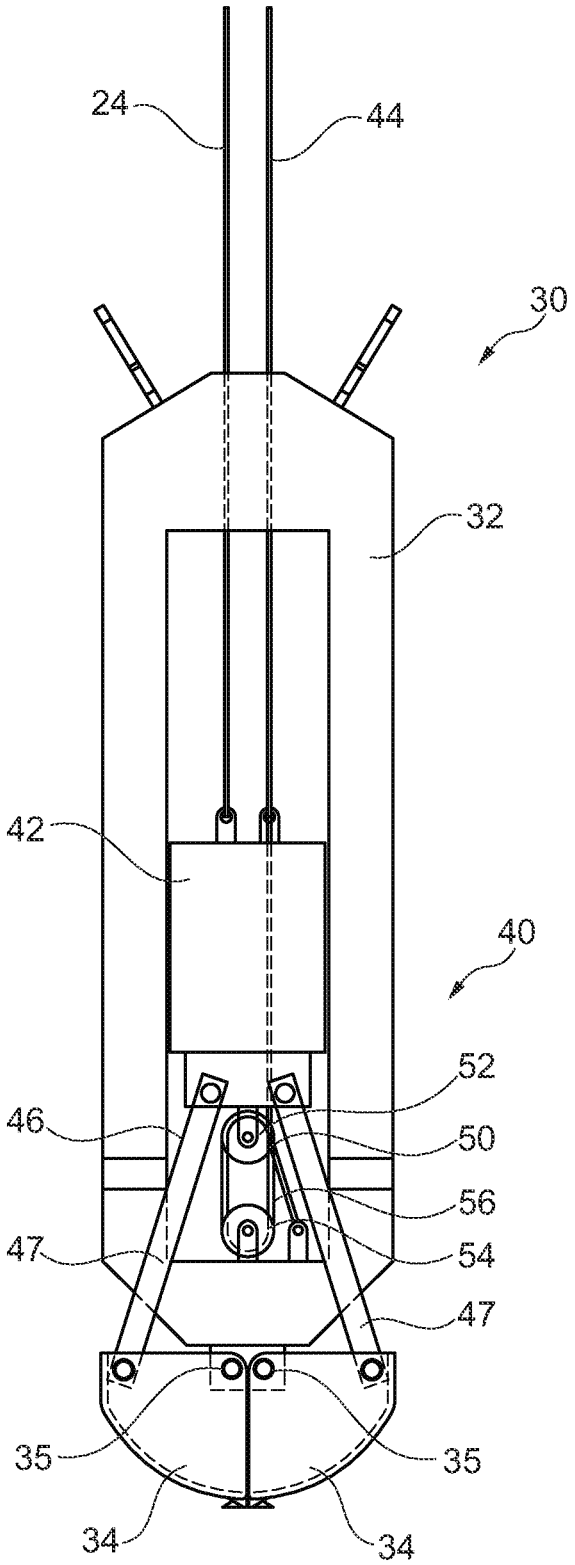
Figure 3:
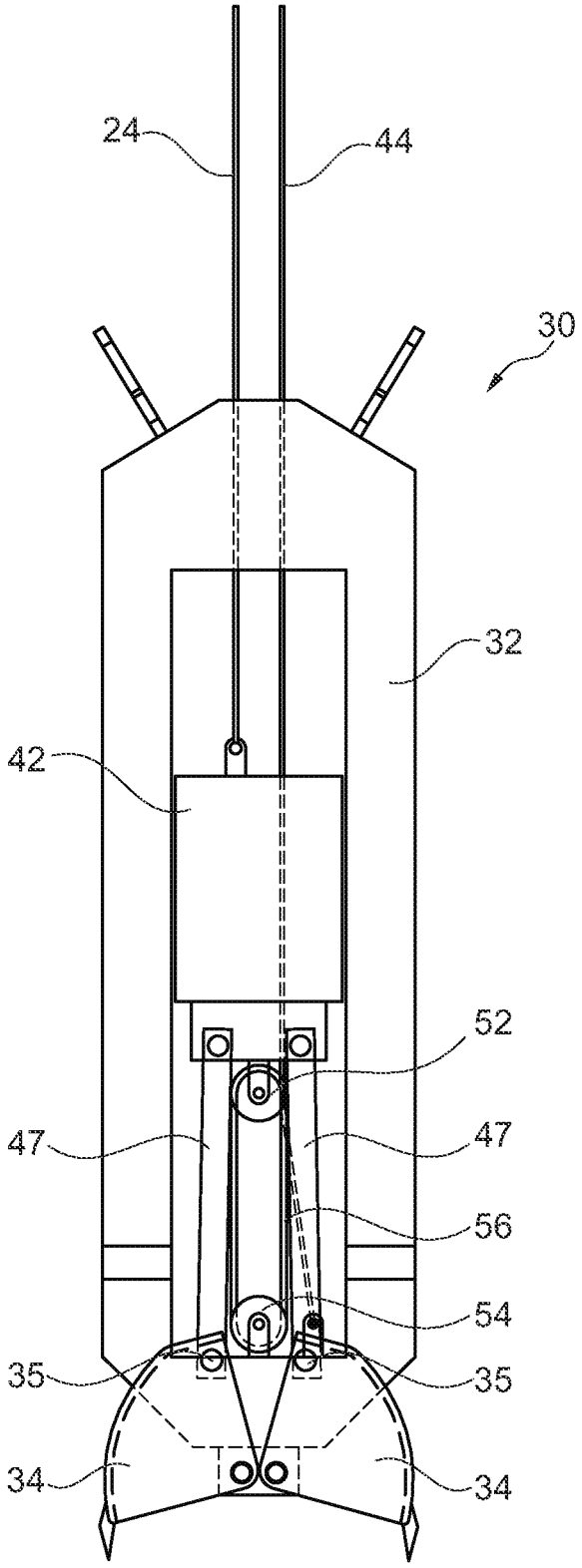

The invention is described in more detail below by reference to a preferred exemplary embodiment, which is illustrated schematically in the drawings. In the drawings show:

FIG. 1 a perspective view of a grab device according to the invention;

FIG. 2 a front view of the cable grab of the grab device of FIG. 1 with closed grab buckets; and FIG. 3 a front view of the cable grab corresponding to FIG. 2 with open grab buckets.

A grab system 10 according to the invention, as shown in FIG. 1, comprises a mobile carrier device 12 with a caterpillar track as an undercarriage 14. An upper carriage 16 with an operator's cab 17 is mounted on the undercarriage 14 for rotation around a vertical rotary axis. Inside the operator's cab 17 there is a control device including an input device for a machine operator.

A cantilever arm 18 is linked on the upper carriage 16, so as to be able to swivel around a horizontal axis. At a head 20 of the cantilever arm 18, a retaining cable 24 is guided by deflection rollers, from the end of which retaining cable is suspended a cable grab 30 having a grab frame 32 and lower grab buckets 34. The retaining cable 24 can be actuated by means of a first cable winch 21 on the carrier device 12 to raise and lower the cable grab 30. In addition, there is a second cable winch 22 on the carrier device 12 for an actuating cable 44, which is likewise guided via the head 20 to the cable grab 30 to actuate the grab buckets 34 on the lower end of the grab frame 32.

The mode of operation of the grab device 10 according to the invention is explained in more detail below in conjunction with FIGS. 2 and 3.

An actuating slide 42 of an actuating device 40 for actuating the grab buckets 34 is mounted in a central region of the grab frame 32 for displacement in a vertical longitudinal direction. The end of the retaining cable 24 is attached to the upper end of the actuating slide 42 so that the cable grab 30 is retained by the actuating slide 42.

A linkage mechanism 46 having linkage rods 47 is arranged on a lower end of the actuating slide 42. The linkage rods 47 are hinged at one side to the actuating slide 42 and at the other side to one of the grab buckets 34. The grab buckets 34 are themselves swivel-mounted on the lower end of the grab frame 32 by means of pivot bearings 35. The grab buckets 34 can be opened and closed by a relative displacement of the actuating slide 42 in relation to the grab frame 32. A relative displacement of the actuating slide 42 upwards causes the linkage rods 47 to be drawn upwards, wherein the grab buckets 34 are swiveled around their swivel axes 35 into their opening position, as is clearly shown in FIG. 3.

Underneath the actuating slide 42, a pulley arrangement 50 is provided for the actuating cable 44. The pulley arrangement 50 comprises at least one top roller 52, which is rotatably mounted on the actuating slide 42, and at least one bottom roller 54, which is rotatably mounted on a lower region of the grab frame 32. The actuating cable 44 loops around the rollers 52, 54 and is feeded from above to form loops 56 or lines, wherein the lower end of the actuating cable 44 is firmly connected to the grab frame 32. The actuating slide 42 is thus adjustably connected or coupled to the grab frame 32 by the actuating cable 44.

Starting from the open position as shown in FIG. 3, the actuating slide 42 is pulled downwards relative to the grab frame 32, using the pulley arrangement 50, by pulling the actuating cable 44 upwards with the second cable winch 22. The linkage rods 47 push the grab buckets 34 downwards with an elevated closing force, wherein the grab buckets 34 are swiveled around their pivot bearings 35 into the closed position as shown in FIG. 2.

When used in a trench in the ground, soil material can be grabbed and enclosed between the grab buckets 34 with an elevated closing force as compared with the tensile force on the actuating cable 44.

After pulling the cable grab 30 out of a trench in the ground and moving it to an emptying position, the tensile force on the actuating cable 44 can be reduced. The weight of the grab frame 32 causes it to move downwards relative to the actuating slide 42, so that the grab buckets 34 are swiveled back into their opening position by the linkage rods 47, as shown in FIG. 3.

This arrangement described is intended as an example only. In principle, other pulley arrangements with different cable linkages and a different linkage mechanism, which allow for a comparable grab bucket actuation, can also be chosen.

When the grab buckets 34 are full, the upper carriage 16 is automatically swiveled out of the position shown in FIG. 1 about 90° around the vertical axis to an emptying position. The cantilever arm 18 can also be adjusted. In the emptying position, the grab buckets 34 are opened to discharge the soil material, even if the cable grab 30 is still oscillating. The cable grab 30 can also be rotated around its longitudinal axis, in order to align it with the skip on a lorry, for example. The upper carriage 16 can then be automatically swiveled back into the position shown in FIG. 1.

From there, the cable grab 30 is lowered into a trench in the ground with the grab buckets 34 open to pick up new soil material. It is then pulled back to the position shown in FIG. 1 with the grab buckets 34 closed and it is emptied again.

When actuating the cable grab 30, it is necessary to coordinate the forces and movements between the retaining cable 24 and the actuating cable 44, in particular to control the torques in the individual cables and hence the torques of the suspended cable grab 30 around its longitudinal axis owing to a so-called lay direction in wound cables.

In accordance with the invention, appropriate detection devices, which can be arranged for example on the cable winches 21, 22 or on the deflection rollers on the head 20 of the cantilever arm 18, are used to detect forces in the retaining cable 24 and the actuating cable 44. Using a control device, which is preferably arranged in the operator's cab 17 on the carrier device 12, the winches 21, 22 can be controlled depending to the detected cable forces so that either a stabilization of the oscillating movement relative to the longitudinal axis or the rotational position of the cable grab 30 around its longitudinal axis or a specific rotation desired by the machine operator is achieved. The machine operator can enter appropriate inputs into the control device to a desired automatic movement, a compensation mode for position stabilizing, or inputs relating to a desired rotational position of the cable grab 30. On the basis thereof, the control device of the upper carriage 16 can control the cantilever arm 18 or the cable winches 21, 22 accordingly, in order to bring about the desired positioning and opening/closing of the cable grab 30. The control of a simple designed cable grab 30 can be considerably simplified and facilitated for a machine operator in this way.

The invention claimed is:

1. A method for operating a grab device comprising a carrier device and a cable grab arranged thereon, the method comprising:

providing the cable grab with a grab frame held by a retaining cable on the carrier device, and at least two grab buckets mounted on a lower end of the grab frame, the at least two grab buckets being configured to swivel between a closed position and an open position, providing an actuating device with an actuating cable for swiveling the grab buckets, wherein the actuating cable is guided from the carrier device to the actuating device, providing the carrier device with a driven first cable winch for the retaining cable, a driven second cable winch for the actuating cable, an undercarriage, and an upper carriage mounted on the undercarriage for rotation about a vertical axis and having a cantilever arm on which the cable grab is vertically adjustably mounted, performing a removal step by lowering the cable grab into the ground by the retaining cable with the grab buckets open to form a trench in the ground, closing the grab buckets to remove and collect soil material, pulling the cable grab out of the ground by the retaining cable and/or the actuating cable and swiveling the cable grab into an emptying position, in which the grab buckets are opened to discharge the collected soil material, by rotating the upper carriage, moving the cable grab back into the ground trench to repeat the removal step after the pulling step, and providing a control device with which a rotation of the upper carriage to the emptying position and an opening and closing of the grab buckets to discharge the soil material and/or a rotation of the upper carriage from the emptying position back to the ground trench and an opening and closing of the grab buckets are controlled automatically.

2. The method according to claim 1, wherein the control device opens the grab buckets while the cable grab is still oscillating, as a consequence of the rotation of the upper carriage.

3. The method according to claim 1,
wherein
an introduction of the cable grab into the ground trench and/or a retraction of the cable grab out of the ground trench is controlled automatically by the control device.

4. The method according to claim 1,
wherein
the control device is connected to and controls the first cable winch and the second cable winch.

5. The method according to claim 2,
wherein
a sensor device is provided with which an oscillating movement of the cable grab during rotation of the upper carriage is detected.

6. The method according to claim 2,
wherein
the grab buckets are opened by the control device at the position at a time when the oscillating cable grab is still in a position deflected out of the vertical position.

7. The method according to claim 2,
wherein
the oscillating cable grab is introduced by the control device into the ground trench, wherein the oscillating movement is damped by contact with the ground.

8. A grab device comprising a carrier device and a cable grab arranged thereon, the grab device comprising:
a grab frame, which is held by a retaining cable on the carrier device,
at least two grab buckets, which are mounted on a lower end of the grab frame, so as to be able to swivel between a closed position and an open position, and
an actuating device with an actuating cable for swiveling the grab buckets,
wherein the actuating cable is guided from the carrier device to the actuating device, and
the carrier device has a driven first cable winch for the retaining cable and a driven second cable winch for the actuating cable,
wherein the carrier device has an undercarriage and an upper carriage, the upper carriage being is mounted on the undercarriage for rotation about a vertical axis and having a cantilever arm from which the cable grab is vertically adjustably suspended,
wherein
the grab device further comprises a control device configured to automatically control a rotation of the upper carriage to an emptying position and an opening and closing of the grab buckets to discharge soil material and/or a rotation of the upper carriage from the emptying position back to a ground trench, wherein an opening and closing of the grab buckets takes place automatically.

9. The grab device according to claim 8,
wherein
the grab device is designed to carry out the method according to claim 8.

10. The grab device according to claim 8,
wherein
a first detection device for detecting a first cable force on the retaining cable and a second detection device for detecting a second cable force on the actuating cable are provided,
the control device is connected to the first detection device, the second detection device, the first cable winch and the second cable winch and is designed to control the first cable winch and/or the second cable winch in accordance with a control program specification, depending on the detected first cable force on the retaining cable and the detected second cable force on the actuating cable.

11. The grab device according to claim 10,
wherein
the control device is designed with a compensation mode in which the cable winches are controlled in such a way that the first cable force on the retaining cable and the second cable force on the actuating cable are matched to each other.

12. The grab device according to claim 8,
wherein
the control device is designed with a rotation mode in which the cable winches are controlled in such a way that a deliberate rotation of the cable grab around a vertical longitudinal axis can be generated.

13. The grab device according to claim 8,
wherein
at least one third detection device for detecting a rotational position of the cable grab and/or a change in the rotational position is provided.

14. The grab device according to claim 8,
wherein
at least one further detection device is provided for detecting a vertical position of the cable grab, a distance and/or an angular position of the cable grab relative to the carrier device.

15. The grab device according to claim 8,
wherein
the retaining cable on the first cable winch has a first lay direction which is opposite to a second lay direction of the actuating cable on the second cable winch.

16. The grab device according to claim 8,
wherein
the control device is designed with a mode for opening and/or closing the grab buckets at a predefined height.

17. The grab device according to claim 8,
wherein
the cable grab can be held freely suspended from the actuating cable and retaining cable, with closed grab buckets, wherein a cable force in the actuating cable and retaining cable is approximately +/−1 t.

18. The grab device according to claim 8,
wherein
the cable grab can be held freely suspended from the actuating cable and retaining cable, with open grab buckets, wherein a cable force in the retaining cable corresponds to almost an entire grab weight and a cable force in the actuating cable is in a range from approximately 1 t to 2 t.

19. The grab device according to claim 8,
wherein
the control device is designed with a mode for automatically opening the grab buckets and closing them immediately afterwards.

20. The grab device according to claim 8,
wherein
a degree of opening of the grab buckets can be detected by the control device and the degree is displayed to an operator.

* * * * *